United States Patent [19]

Keller

[11] 3,970,228

[45] July 20, 1976

[54] FLASHLIGHT AND FLASHLIGHT HOLDER

[75] Inventor: Donald A. Keller, Temecula, Calif.

[73] Assignee: VSI Recreational Products, Fullerton, Calif.

[22] Filed: Feb. 26, 1975

[21] Appl. No.: 553,230

[52] U.S. Cl. ..... 224/5 H; 224/3

[51] Int. Cl.[2] ..... A45F 5/00

[58] Field of Search ..... 224/5 R, 5 A, 26 R, 224/26 B, 5 H, 2 D, 1 R, 3, 27

[56] References Cited

UNITED STATES PATENTS

| | | | |
|---|---|---|---|
| 2,399,040 | 4/1946 | Karle | 224/5 H X |
| 2,602,574 | 7/1952 | Mangold et al. | 224/26 R X |
| 2,894,119 | 7/1959 | Stenger | 224/5 A |
| 3,307,754 | 3/1967 | Anketell | 224/1 R |

*Primary Examiner*—Robert J. Spar
*Assistant Examiner*—Jerold M. Forsberg
*Attorney, Agent, or Firm*—Christie, Parker & Hale

[57] ABSTRACT

A flashlight holder ring receives the body of a flashlight. The diameter of the head of the flashlight exceeds the diameter of the ring so that the head cannot pass through the ring. An on-off switch housing and guard protrudes from the body of the flashlight and prevents withdrawal of the light from the ring. Registration of a bridge or arch section of the ring with the housing and guard permits freeing the flashlight from the ring. A strap attached to the ring at the bridge provides for attachment to a belt.

2 Claims, 3 Drawing Figures

Fig. 1
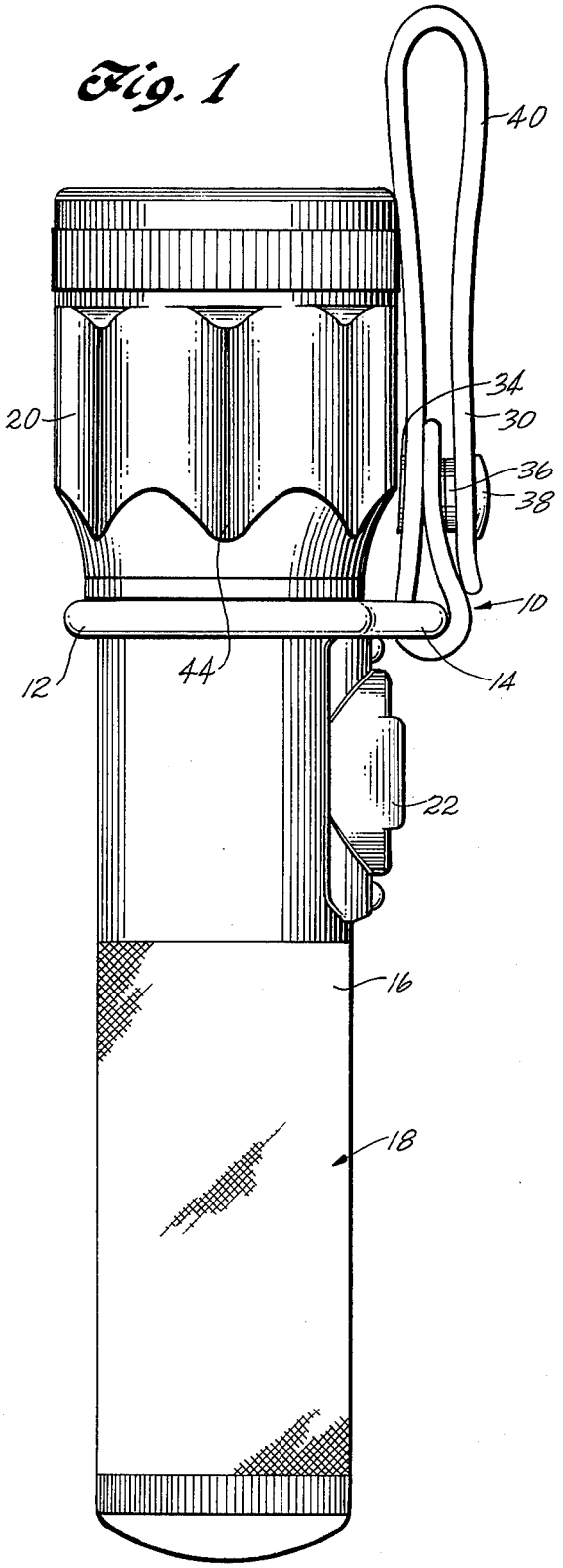
Fig. 2
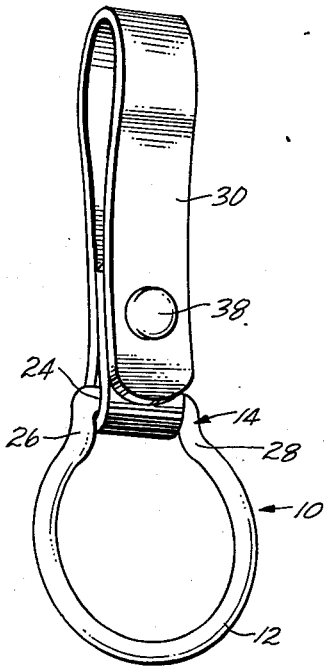
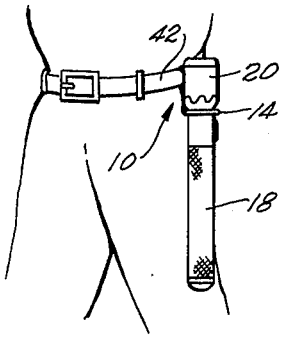
Fig. 3

FLASHLIGHT AND FLASHLIGHT HOLDER

BACKGROUND OF THE INVENTION

The present invention relates to holders for flashlights in general and more in particular to a flashlight holder which keeps the flashlight with the holder unless the two are brought into a predetermined orientation.

Flashlight holders enable the easy carriage of a flashlight by a person. The holders may be adapted to carry the flashlight on a belt.

A flashlight holder should be inexpensive, unencumbering and easy to fix to a person. The holder should allow use of the flashlight without removal from the holder and easy flashlight removal from the holder when occasion demands.

SUMMARY OF THE INVENTION

The present invention provides a flashlight holder having a ring of an internal diameter greater than the body of a flashlight but less than a head of a flashlight. The ring has a bridge or arch which defines a step in the ring's circumference for passage over a housing for an on-off switch on the body. Unless the bridge longitudinally registers with the housing the flashlight interferes with the ring in either direction along the flashlight's longitudinal axis. A carrying strap attaches to the bridge section and preferably has a loop and a snap to close the loop. The loop provides attachment to a person's belt and the snap provides a means for attachment to a belt without removing the belt.

These and other features, aspects and advantages of the present invention will become more apparent from the following description, appended claims and drawings.

BRIEF DESCRIPTION OF THE DRAWINGS

FIG. 1 is a view of a flashlight holder and flashlight of the present invention;

FIG. 2 is a perspective view of the flashlight holder shown in FIG. 1; and

FIG. 3 illustrates the flashlight holder and flashlight in use.

DESCRIPTION OF THE PREFERRED EMBODIMENTS

With reference initially to FIGS. 1 and 2, a flashlight holder 10 includes a ring 12. A bridge or arch section 14 of the ring defines a step of an arched internal diameter for the ring. The internal diameter of the ring is greater than the diameter of a body 16 of a flashlight 18, but less than the diameter of a head 20 of the flashlight. A housing and guard 22 for an on-off switch mounts on body 16 of the flashlight.

Bridge section 14 has a span for clearing housing and guard 22. Specifically, the bridge section has a bight 24 connected to the balance of the ring by a pair of spaced apart legs 26 and 28. The distance between legs 26 and 28 exceeds the width of housing and guard 22. A carrying strap 30 attaches to ring 12 at bridge 14. The distance from the strap on the inside of the bight diametrically to the inside of the ring is greater than the diameter of the flashlight body plus the height of housing and guard.

The clearance afforded by the spacing of legs 26 and 28 and the bight and strap both with respect to the housing and guard enables a flashlight to be slipped free of the holder by lifting the light through the holder when the housing and guard registers with the bridge or arch.

The diameter of the ring outside of the bridge or arch is less than the diameter of the flashlight body plus the height of the housing and guard so that the flashlight cannot be pulled through the ring unless the ring and housing and guard are in register.

The strap, as previously mentioned, attaches to the ring by looping under bight 24 of bridge or arch section 14. It is fastened onto itself as by a rivet 34 which also provides a conventional female socket 36 for a male portion 38 of a snap. The strap has a loop 40 for attachment to a belt of a person.

With brief reference to FIG. 3, the flashlight carried by a person is illustrated. Flashlight 18 is carried by a holder 10 from a belt 42 of the user. Ring 12 holds the flashlight by interfering with head 20 thereof. Removal of the light requires registration of on-off switch housing and guard 22 with bridge or arch section 14 and drawing the flashlight through ring 12. The flashlight is replaced by reversing the procedure. The attachment of strap 30 to the ring is loose and thus the flashlight can be twisted and used without taking the flashlight out of the holder. The strap and snap allow the holder to be attached to a person's belt without removing the belt. The flashlight is flush against the side of a person and provides a minimum of obstruction. The flush repose of the light against the side of a person results from the use of the bridge section as the attachment section for the strap. Thus the bridge section serves the functions of strap retention and as a key to free the flashlight from the holder. Rivet 34 also nests in flutes 44 of head 20 of the flashlight.

The present invention has been described with reference to a preferred embodiment. The spirit and scope of the appended claims should not, however, necessarily be limited to this description.

What is claimed is:

1. In combination with the flashlight of the type having a body, an on-off switch housing on the body extending a height therefrom, a head on the body having a diameter greater than the body, an improved flashlight holder comprising:

a. a ring having a diameter greater than the diameter of the body but less than the diameter of the head and less than the diameter of the body plus the height of the on-off switch housing;

b. a bridge of the ring defining a pair of generally parallel legs extending in a direction outwardly away from the center of the ring and merging into the balance of the ring, and a bight connecting the legs;

c. a strap for attaching a flashlight to a person having one end looped around the bight and attached to itself to define a closed loop loosely securing the strap to the ring and permitting the ring to rotate in the strap about the axis of the bight; and d. the distance measured from a point on the ring opposite the bight to the most proximate surface of the strap on the inside of the bight being greater than the diameter of the body of the flashlight and the height of the on-off switch housing, and the distance between the legs of the bight being greater than the width of the on-off switch housing;

whereby, the on-off switch housing can pass through the bridge for inserting and removing the flashlight from the holder and the holder interferes with the on-off switch housing when such housing is out of register with the bridge to lock the flashlight to the holder when the on-off switch housing is below the ring and hold without such locking the flashlight when the on-off switch housing is above the ring.

2. The combination claimed in claim 1 wherein the strap has snap means for defining a loop for the attachment and removal of the holder to the belt of a person.

* * * * *